United States Patent [19]

Bocca et al.

[11] 4,138,912

[45] Feb. 13, 1979

[54] UNIT FOR PROGRAMMED CONTROL OF BLANKING MACHINES

[75] Inventors: Giuseppe Bocca; Tiziano Mostura; Bruno Valli, all of Vigevano (Pavia), Italy

[73] Assignee: Elemac S.p.A., Vigevano, Italy

[21] Appl. No.: 699,967

[22] Filed: Jun. 25, 1976

[51] Int. Cl.[2] ..... B26D 5/00

[52] U.S. Cl. ..... 83/69; 408/8; 83/57

[58] Field of Search ..... 83/69, 522, 549, 57; 408/8.9

[56] References Cited

U.S. PATENT DOCUMENTS

| | | | |
|---|---|---|---|
| 2,346,719 | 4/1944 | Aske | 83/69 |
| 2,587,214 | 2/1952 | Polk | 83/69 |
| 3,143,900 | 8/1964 | Oeckl et al. | 408/8 |
| 3,722,335 | 3/1973 | Labonte et al. | 83/57 |

FOREIGN PATENT DOCUMENTS

| | | | |
|---|---|---|---|
| 758135 | 9/1956 | United Kingdom | 408/9 |

*Primary Examiner*—Donald R. Schran

*Attorney, Agent, or Firm*—Haseltine, Lake & Waters

[57] ABSTRACT

The invention relates to an assembly of members for programming and controlling the process of a blanking or die cutting machine, which process, because of simply comprising shearing machine blows, is programmed and controlled by merely fixing before hand the amount of blows that the machine should give, and then controlling the given blows. The invention is characterized in that the assembly or unit comprises a filing cabinet intended to accomodate the blanks or die cuts to be used for the process, each file being provided with members responsive to the presence of said blanks or die cuts, so that as a blank or die cut is withdrawn or picked up, the relative programming members are activated as set on the control board.

1 Claim, 3 Drawing Figures

UNIT FOR PROGRAMMED CONTROL OF BLANKING MACHINES

This invention relates to a unit for programmed control of blanking or die cutting machines, and more particularly an apparatus that can be electrically coupled to a blanking or die cutting machine, the apparatus being characterized by comprising a plurality of files intended to accomodate different blanks or die cuts, particularly blanks or die cuts for shearing pieces in footwear manufacture, such files being provided with means responsive to the presence or absence of said blanks or die cuts, and the activation of which causes the operation of the blanking or die cutting machine and a blow counter controlling the number of blows effected by the machine. The activation of said responsive means causes, separately for each of the blanks or die cuts, a programmed numerical setting for the blanking or die cutting machine output, as well as the final control for the work being carried out, both separately blank by blank, and totally for all the blanks or die cuts together.

Such an apparatus does not exist at present, since only blow counters are known for numerically controlling the work of a single blank or die cut.

In order that the structure and features of a unit according to the present invention be more clearly understood, a merely unrestrictive exemplary embodiment thereof will now be described, reference being had to the accompanying drawings, in which.

Figure 1:
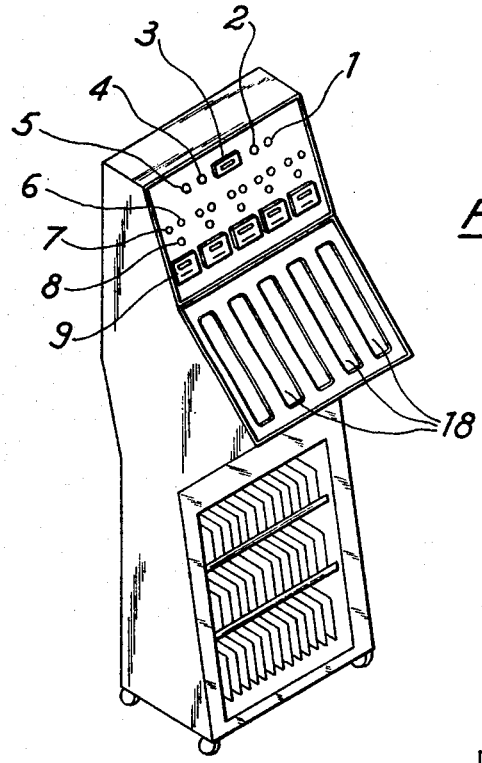
FIG. 1 is an external perspective view of the apparatus.

The control board of the apparatus shown in FIG. 1 has provided thereon a general switch 1, an indicator or warning lamp 2 and a totalizing blow counter 3 counting all together the blows as given by the blanking or die cutting machine associated with the apparatus without any discrimination as to the blank or die cut being used.

A warning lamp 4, lighting up when one and only one blank or die cut is removed out of any of files 18, the other files remaining occupied, indicates that the unit is activated and accordingly ready to operate. This is the moment at which the blank or die cut withdrawn from the file is inserted into the conventional type of blanking or die cutting machine, and the work or process can be started, provided that care has been or is taken for program setting on the control board, that is fixing for each individual blank or die cut the number of pieces to be sheared.

For program setting, each file 18 is provided with a corresponding blow counter 9 having two window or slot members, one of which for establishing by means of setting up pushbuttons the maximum number or amount of blows that the blanking or die cutting machine should reach, and the other of which for progressively counting the blows given by the blanking or die cutting machine still in connection with one single blank or die cut. Upon reaching the predetermined maximum number, a warning lamp 8 of count termination will light up.

A switch button 5 is provided on the control board for allowing, when required, an out-of-count blow of the blanking or die cutting machine, in case this occurring should a blank or die cut turn out to be faulty and has to be repeated, but without counting thereof.

For each of files 18, said control board also has arranged thereon a switch 6, enabling for functionally cutting out the blank or die cut from the circuit and hence from the unit, and this independently of whether the blank or die cut is present or not in the file.

A rheostat 7 is also provided for each file, this rheostat enabling to vary the pressing effect of the blank or die cut in relation to the total cutting surface of the blank or die cut, that is in connection with the larger or smaller force being required for blanking or die cutting operation. When providing for program setting on the control board, the several rheostats 7 will be set or adjusted, which rheostats could be however adjusted and set up at any time.

Files 18 have such a width that blanks or die cuts of different sizes can be accomodated therein. However, in order to hold such blanks or die cuts at the file openings and within reach, each file has an adjustable movable bottom which can be moved more or less close to the file opening by sliding along a guide 12 through operation of a lever 11 provided with a blocking member 10. Thus, the depth of each file can be dimensioned in relation to the sizes of blanks or die cuts 15 being inserted therein.

By sliding on a sloping plane or ramp, such blanks or die cuts 15 will weigh on a rod 13, at the end of which a microswitch 14 is arranged, this microswitch being a member responsive to the blank or die cut presence or absence. This member can be differently embodied: for example, it could be a photocell, a magnetic or the like member, provided that it be operated upon withdrawing or putting back the blank or die cut.

Whatever it may be, said member 14 causes warning lamp 4 to light up when one and only one blank or die cut is withdrawn, the other blanks or die cuts remaining in position or at neutral state. Lighting up of lamp 4 indicates that the unit is activated, a blank or die cut is made available for the blanking or die cutting machine, and accordingly, upon insertion of the blank or die cut into the machine, the blanking or die cutting process can be started. As the blank or die cut is moved back to position, warning lamp 4 will be extinguished, thus enabling to pass to another blank or die cut.

Electric current is tapped from mains to the unit which, therefore, has two terminals 16 for mains connection. For electrical connection to the blanking or die cutting machine, said unit has three terminals 17 for the necessary connections.

Should the unit be used, for example, for program and control setting of a blanking or die cutting machine intended to blank or die cut pieces in footwear manufacture, such as uppers, soles, foot-straps, spurs, toes, it would be possible to establish before hand which blanks or die cuts to use by separate insertion thereof into the files and fix for each blank or die cut the amount of pieces that shall be sheared.

The unit could comprise two or more files with associated members. Should there be an excess number of files with associated members in carrying out a program, the exceeding files can be neutralized, and this by merely acting on the switches 6 for the undesired files.

When having to change the process program, the blanks or die cuts in the unit will be withdrawn or picked up and replaced by other blanks or die cuts.

Through the means at present known, when a program is set for sole blanking or die cutting (blank or die cut 15 in FIG. 2), said blank or die cut is withdrawn or picked up from storage and directly inserted into the blanking or die cutting machine (not shown). The amount of soles to be provided, that is the amount of blows to be given, will be set on the machine, with automatic stop and final counting by a numerical indicator blow counter. When changing the blank or die cut for blanking or die cutting different articles, the same sequence will be followed as in the case of blank or die cut 15, that is another blank or die cut will be withdrawn from storage to replace the former blank or die cut.

The same will be repeated if the program would provide to blank or die cut a plurality of different articles, such as a series of pieces intended to footwear manufacture, such as soles, foot-straps, uppers, spurs, toes, etc.

On the other hand, with an apparatus according to the present invention the operation is as follows.

Figure 2:
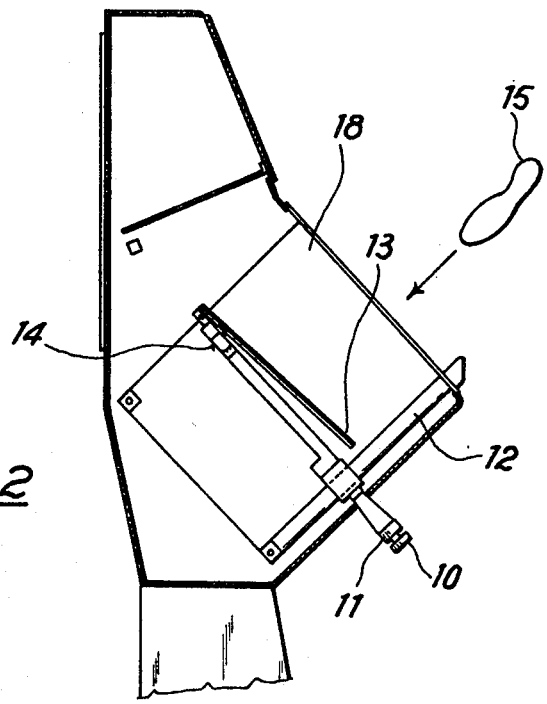
FIG. 2 is an enlarged sectional view taken at any of the housing seats or files for the blanks or die cuts.
Figure 3:
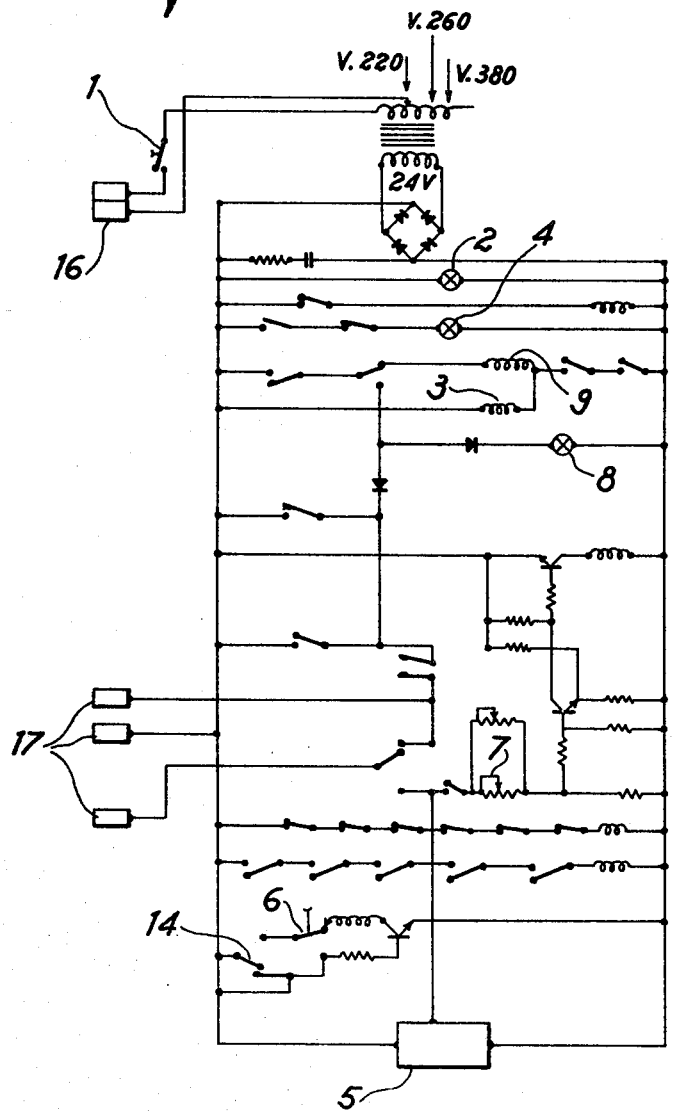
FIG. 3 shows the electric circuit diagram associated with the apparatus shown in FIGS. 1 and 2.

The blanks or die cuts (such as a series of blanks or die cuts for shearing soles, uppers, foot-straps, spurs, toes) are withdrawn or picked up from storage and separately inserted into files 18 (see in FIG. 2 blank or die cut 15 being introduced). Then, for each blank or die cut the amount of pieces to be sheared are set or programmed on the control board, and this by means of two-slot blow counter 9, of which one serves for fixing the amount of pieces to be sheared, and the other for counting the blows, that is for counting the sheared pieces. On reaching the predetermined amount, the blanking or die cutting machine will be automatically stopped.

Once the general programming has been preset, nothing will still occur, except for signal lights on the control board.

When one of the blanks or die cuts is extracted for insertion into the blanking or die cutting machine, said microswitch 14 or other responsive member will perceive that the blank or die cut has been withdrawn or picked up and arrange the blow counter associated with the withdrawn blank or die cut at starting position.

When the blanking or die cutting machine is operated, after having inserted therein both the blank or die cut and material to be blanked, the blow counter will be automatically operated.

What we claim is:

1. A unit for programmed control blanking or die cutting machines, comprising: a plurality of files for receiving different blanks or die cuts, means (13,14) in said files for responding to the presence of blanks or die cuts, a counter allowing presetting of a number of process steps to be applied to blanks or die cuts means for controlling the number of applied process steps; means for signaling the number of applied process steps; means for comparing the number of applied process steps with the number preset into said counter during operation, each file having a bottom; said means for responding to presence of blanks or die cuts comprising:

a lever located at the bottom of a respective file, switch means actuated by said lever, said lever being displaced by weight of a blank or die cut, withdrawal of a blank or die cut activating said lever, each file having depth, a support for said lever and slidable along the depth of a respective file, a guide member extending along the depth of said respective file, a guide member extending along the depth of said respective file for guiding said support, said support being adjustable along the guide member, and a blocking member on said support for a bar fixing said support to said guide member at a predetermined location, said guide member being substantially inclined with respect to a horizontal plane, said files having openings substantially at right angles to said guide member, said files having depth adjustable by varying the location of said support on said guide member, said counter comprising a two-slot counter for numerical setting and for numerical control, a warning light for signalling attainment of a maximum number of process steps according to the pre-set number of process steps, a rheostat for regulating a parameter of a processing step, a control board with a totalizing counter for adding all sums of the individual counters associated with said file, a warning lamp indicating when a blank or die cut has been withdrawn from a file, switch means providing for possible repetition out of counting for a faulty blank or die cut.

* * * * *